US011086259B2

(12) United States Patent
Hatori

(10) Patent No.: US 11,086,259 B2
(45) Date of Patent: Aug. 10, 2021

(54) IMAGE FORMING APPARATUS TO WHICH TONER CONTAINER IS ATTACHABLE

(71) Applicant: CANON KABUSHIKI KAISHA, Tokyo (JP)

(72) Inventor: Takahisa Hatori, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/733,419

(22) Filed: Jan. 3, 2020

(65) Prior Publication Data

US 2020/0218188 A1 Jul. 9, 2020

(30) Foreign Application Priority Data

Jan. 9, 2019 (JP) ..... JP2019-002018

(51) Int. Cl.
*G03G 15/00* (2006.01)
*G03G 15/08* (2006.01)

(52) U.S. Cl.
CPC ..... *G03G 15/553* (2013.01); *G03G 15/086* (2013.01); *G03G 15/087* (2013.01); *G03G 15/0856* (2013.01); *G03G 15/0858* (2013.01); *G03G 15/0862* (2013.01); *G03G 15/0872* (2013.01); *G03G 15/0894* (2013.01); *G03G 15/55* (2013.01); *G03G 15/556* (2013.01); *G03G 2215/066* (2013.01); *G03G 2215/0663* (2013.01); *G03G 2215/0665* (2013.01); *G03G 2215/0888* (2013.01); *G03G 2215/0891* (2013.01)

(58) Field of Classification Search
CPC ..... G03G 15/00856; G03G 15/0858; G03G 15/086; G03G 15/0862; G03G 15/0868; G03G 15/087; G03G 15/0872; G03G 15/55; G03G 15/553; G03G 15/556; G03G 2215/066; G03G 2215/0663; G03G 2215/0665; G03G 2215/0888; G03G 2215/0891
See application file for complete search history.

(56) References Cited

U.S. PATENT DOCUMENTS

2010/0247119 A1* 9/2010 Kawahara ..... G03G 21/12 399/35
2015/0071659 A1* 3/2015 Iikura ..... G03G 15/556 399/27
2018/0299815 A1* 10/2018 Sakaguchi ..... G03G 15/5016

FOREIGN PATENT DOCUMENTS

JP 2009151180 A 7/2009

* cited by examiner

*Primary Examiner* — Joseph S Wong
(74) *Attorney, Agent, or Firm* — Rossi, Kimms & McDowell LLP

(57) ABSTRACT

A developing device develops an electrostatic latent image formed on a photosensitive drum. A bottle rotation sensor detects rotation of a toner bottle that stores toner. A bottle motor drives the toner bottle for rotation to thereby discharge toner from the toner bottle. A hopper-internal toner sensor detects presence/absence of toner stored in a hopper that stores toner discharged from the toner bottle. A replenishment unit replenishes toner stored in the hopper to the developing device. Which of failure of the bottle rotation sensor and rotation failure of the toner bottle has occurred is determined based on a detection result of the bottle rotation sensor and a detection result of the hopper-internal toner sensor.

13 Claims, 11 Drawing Sheets

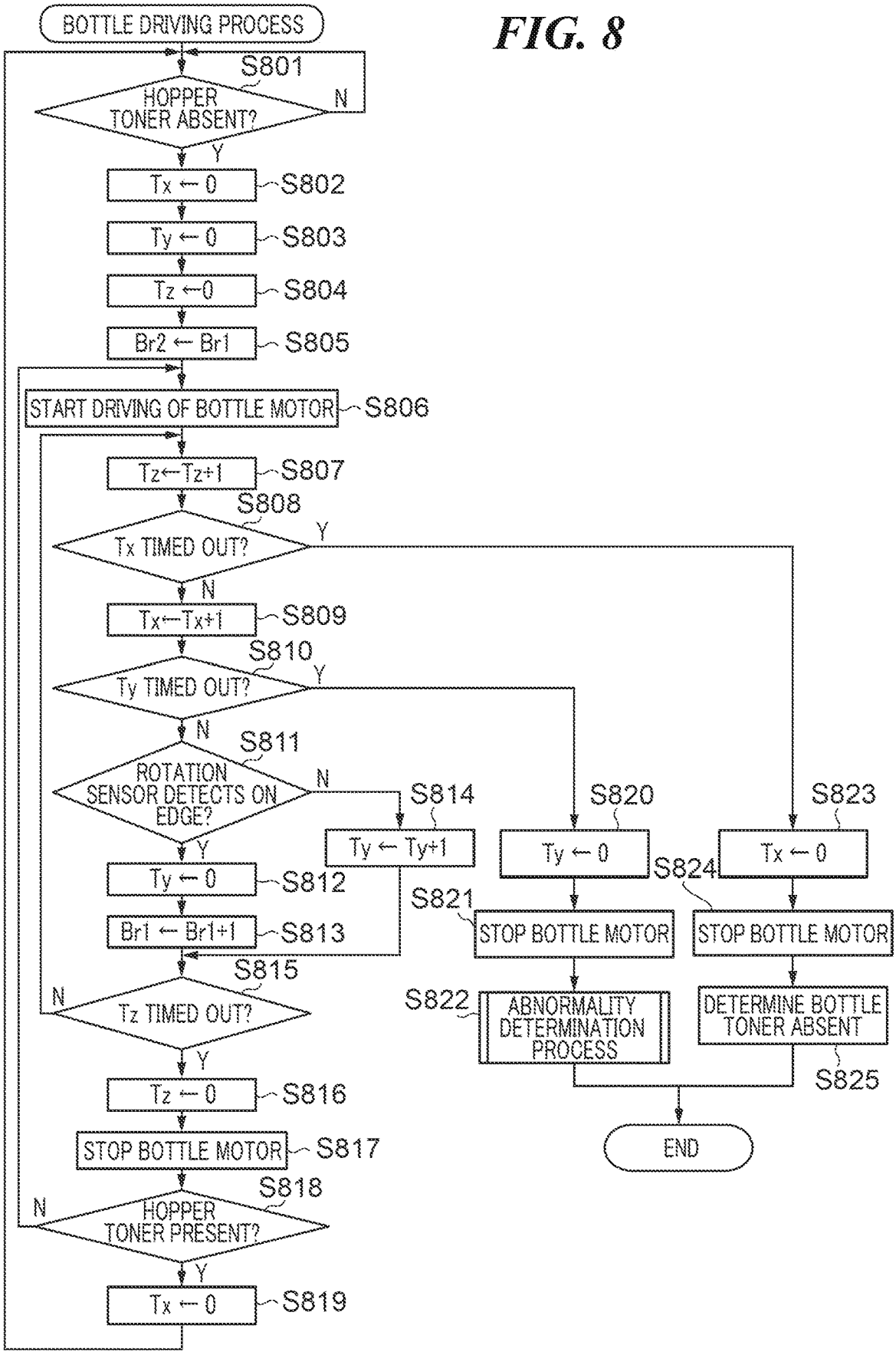
FIG. 8
BOTTLE DRIVING PROCESS
S801
HOPPER TONER ABSENT?
N
Y
Tx ← 0
S802
Ty ← 0
S803
Tz ← 0
S804
Br2 ← Br1
S805
START DRIVING OF BOTTLE MOTOR
S806
Tz ← Tz+1
S807
S808
Tx TIMED OUT?
Y
N
Tx ← Tx+1
S809
S810
Ty TIMED OUT?
Y
N
S811
ROTATION SENSOR DETECTS ON EDGE?
N
Y
S814
Ty ← Ty+1
S820
Ty ← 0
S823
Tx ← 0
S824
Ty ← 0
S812
Br1 ← Br1+1
S813
S821
STOP BOTTLE MOTOR
STOP BOTTLE MOTOR
S815
Tz TIMED OUT?
N
Y
S822
ABNORMALITY DETERMINATION PROCESS
DETERMINE BOTTLE TONER ABSENT
S825
Tz ← 0
S816
STOP BOTTLE MOTOR
S817
END
S818
HOPPER TONER PRESENT?
N
Y
Tx ← 0
S819

*FIG. 11A*

Abnormality has occurred.
(Contact Service Person in Charge)

Abnormality Code: AAAA
Abnormal Spot: hopper

*FIG. 11B*

Abnormality has occurred.
(Contact Service Person in Charge)

Abnormality Code: AAAA
Abnormal Spot: toner bottle

*FIG. 11C*

Abnormality has occurred.
(Contact Service Person in Charge)

Abnormality Code: AAAA
Abnormal Spot: unidentified

IMAGE FORMING APPARATUS TO WHICH TONER CONTAINER IS ATTACHABLE

BACKGROUND OF THE INVENTION

Field of the Invention

The present invention relates to an image forming apparatus to which a toner container is attachable.

Description of the Related Art

Conventionally, image forming apparatuses of an electrophotographic type, an electrostatic recording type, and so forth, to which a toner container storing toner is attachable, include a known one that replenishes toner in the toner container to a developing device via a container (referred to as the hopper). The known image forming apparatus supplies, when toner in the hopper becomes insufficient, toner to the hopper by rotating the attached toner container. This causes toner to be stored in the hopper, which is used for development by the developing device. At this time, whether or not the toner container is rotating is monitored by a rotation sensor. If rotation of the toner container is not detected, an abnormality message is displayed on a screen. However, there are various kinds of causes why rotation of the toner container is not detected, and hence it takes a time to identify the cause.

Assuming that it is assured that a power supply circuit board and a motor are normally operating, it is possible to consider, as the main cause of disabling the rotation sensor from detecting rotation of the toner container, failure of the rotation sensor itself and rotation failure of the toner container e.g. due to faulty attachment of the toner container. For example, in the case of faulty attachment of the toner container, load on a gear increases, which causes improper rotation of the toner container or disables the toner container from rotating. In recent years, the number of units, as components associated with the developing device, has been increased, and hence if it is possible to quickly and accurately identify a unit to be replaced according to the cause of a failure, this leads to reduction of downtime.

An image forming apparatus disclosed in Japanese Laid-Open Patent Publication (Kokai) No. 2009-151180 includes a current detecting circuit provided in a bottle motor that rotates a toner container, and determines whether or not an overload (heavy load) of the toner container has occurred, based on a value of electric current flowing through the bottle motor. In the disclosed image forming apparatus, in a case where it is determined that an overload has occurred, it is determined that faulty attachment of the toner bottle has occurred, and the downtime is reduced by prompting a user to reattach the toner bottle.

However, in the disclosed image forming apparatus, it is necessary to provide the exclusive current detection circuit in the bottle motor, and hence the configuration becomes complicated and further it is disadvantageous from the viewpoint of cost.

SUMMARY OF THE INVENTION

The present invention provides an image forming apparatus capable of determining which of failure of a detection unit for detecting rotation of a toner container and rotation failure of the toner container has occurred, without providing a component for detecting a drive load.

The present invention provides an image forming apparatus comprising a photosensitive member, an exposure unit configured to expose the photosensitive member to form an electrostatic latent image, a developing unit configured to develop the electrostatic latent image formed on the photosensitive member with toner, an attachment section to which a toner container that stores toner is attachable, a drive unit configured to drive the toner container attached to the attachment section, for rotation, to discharge toner from the toner container, a storage section configured to store the toner discharged from the toner container attached to the attachment section, a replenishment unit configured to replenish the toner stored in the storage section to the developing unit, a first detection unit configured to detect rotation of the toner container attached to the attachment section, a second detection unit configured to detect the toner stored in the storage section, and a determination unit configured to determine, based on a detection result of the first detection unit and a detection result of the second detection unit, which of failure of the first detection unit and rotation failure of the toner container has occurred.

According to the present invention, it is possible to determine which of failure of the detection unit for detecting rotation of the toner container and rotation failure of the toner container has occurred, without providing a component for detecting a drive load.

Further features of the present invention will become apparent from the following description of exemplary embodiments (with reference to the attached drawings).

BRIEF DESCRIPTION OF THE DRAWINGS

FIG. 8 is a flowchart of a bottle driving process.

FIGS. 11A to 11C are diagrams each showing an example of display of an abnormality notification.

DESCRIPTION OF THE EMBODIMENTS

The present invention will now be described in detail below with reference to the accompanying drawings showing embodiments thereof.

Figure 1:
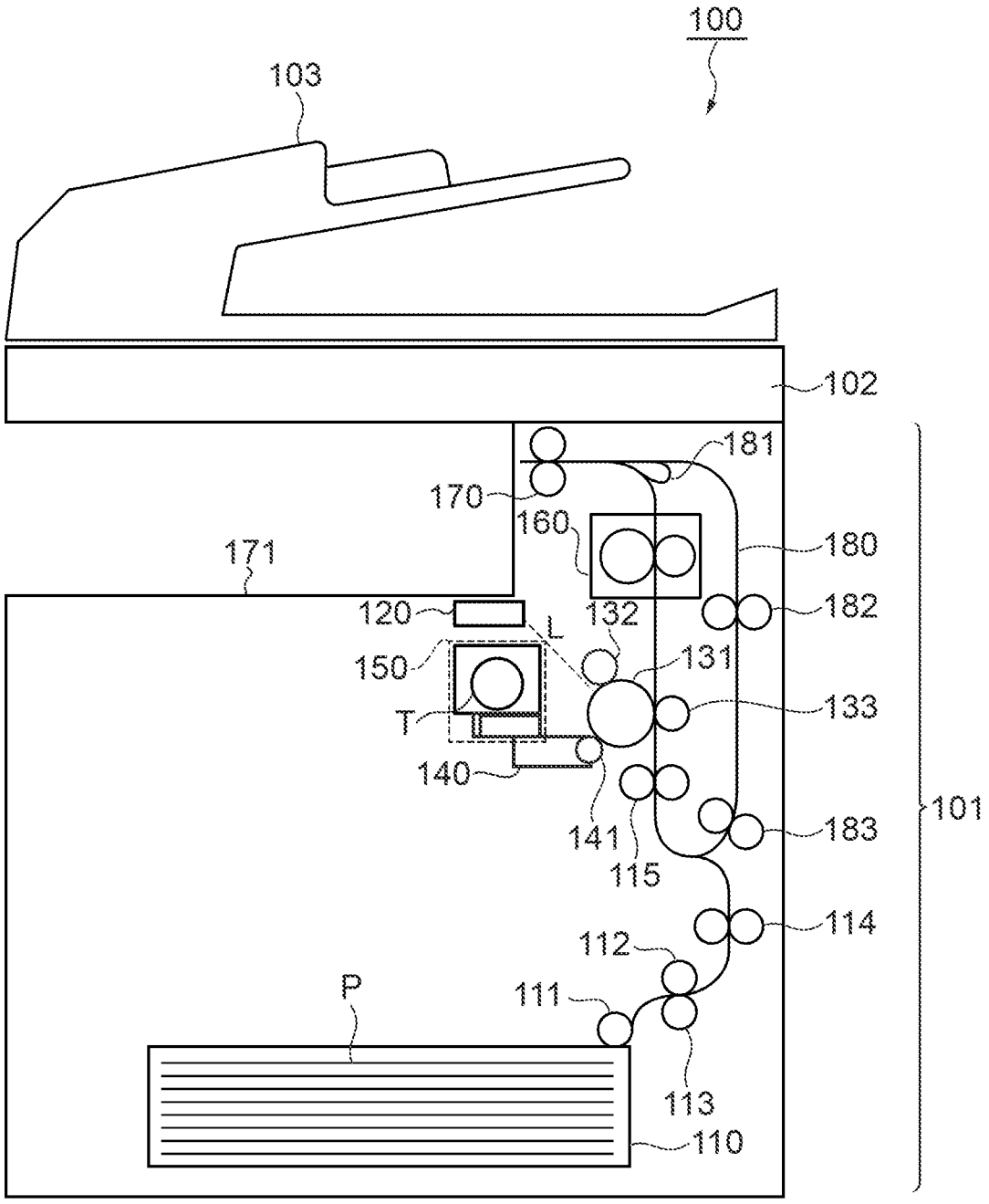
FIG. 1 is a schematic cross-sectional view of an image forming apparatus.

FIG. 1 is a schematic cross-sectional view of an image forming apparatus according to an embodiment of the present invention. This image forming apparatus, denoted by reference numeral 100, includes a printer unit 101 that performs image formation on a sheet, a reader unit 102 that reads an image of an original, and an ADF unit 103 that conveys an original to be read. Note that the sheet may be referred to as a recording sheet, a recording material, a recording medium, paper, a transfer material, a transfer sheet, and the like.

In the printer unit 101, recording sheets P, stored in a sheet feed cassette 110, are fed to a conveying path by a pickup roller 111, a sheet feeding roller 112, and a retard roller 113, one by one. Each recording sheet P fed from the sheet feed cassette 110 is conveyed along the conveying path by a sheet feeder conveying roller 114. When the recording sheet P has reached a position of a registration roller pair 115, skew of the sheet P is corrected by the registration roller pair 115 at rest. After that, the registration roller pair 115 starts to rotate to thereby convey the recording sheet P to a transfer nip between a photosensitive drum (photosensitive member) 131 and a transfer roller 133.

The printer unit 101 has an image forming section that forms an image on a recording sheet P, and the image forming section is comprised of a laser scanner unit 120, the photosensitive drum 131, a charge roller 132, the transfer roller 133, and a developing device 140. In the image forming section, an outer peripheral surface of the photosensitive drum 131, which is driven for rotation, is uniformly charged to a potential of a predetermined polarity by action of the charge roller 132. The laser scanner unit 120 is an exposure unit configured to expose the charged photosensitive drum 131 with a light beam (laser light). More specifically, the laser scanner unit 120 outputs laser light L modulated according to image information (time-series digital pixel signal), and scans the charged photosensitive drum 131 with the laser light L to thereby form an electrostatic latent image on the photosensitive drum 131. The laser scanner unit 120 outputs the laser light L based on image data (image information) obtained by the reader unit 102 that reads an image of an original, or based on image data received from an external apparatus, such as a personal computer, via a network.

The developing device 140 includes a developing roller 141 and develops an electrostatic latent image on the photosensitive drum 131 with toner supplied (replenished) from a toner replenishment unit 150 which includes a toner bottle T, to thereby form a toner image. To form the toner image, toner corresponding to the image data is discharged from the developing device 140. The toner image formed on the photosensitive drum 131 is moved to the transfer nip in accordance with rotation of the photosensitive drum 131. A transfer bias of a polarity opposite to the polarity of the photosensitive drum 131 is applied to the transfer roller 133, whereby the toner image on the photosensitive drum 131 is transferred onto a surface of the recording sheet P at the transfer nip.

The recording sheet P having the toner image transferred thereon in the image forming section is conveyed into a fixing device 160. The fixing device 160 applies heat and pressure to the recording sheet P using a fixing heater and a pressure roller to thereby fix the toner image on the recording sheet P. The recording sheet P on which the image has been thus formed is discharged, after passing the fixing device 160, onto a discharge tray 171 outside the apparatus by a discharge roller 170.

Further, in a case where double-sided printing is performed on the recording sheet P, the recording sheet P on a first side of which image formation has been finished passes the position of an inversion flapper 181 and is then conveyed in an opposite direction by the discharge roller 170 and guided to an inversion conveying path 180 by the inversion flapper 181. The recording sheet P having been guided to the inversion conveying path 180 is conveyed to the position of the registration roller pair 115 again by inversion section conveying rollers 182 and 183. At this time, the first side and a second side of the recording sheet P are inverted from when the image forming operation was performed on the first side. Then, image formation is performed on the second side of the recording sheet P similarly to the above-mentioned image formation on the first side, and then the recording sheet P is discharged onto the discharge tray 171.

Figure 2:
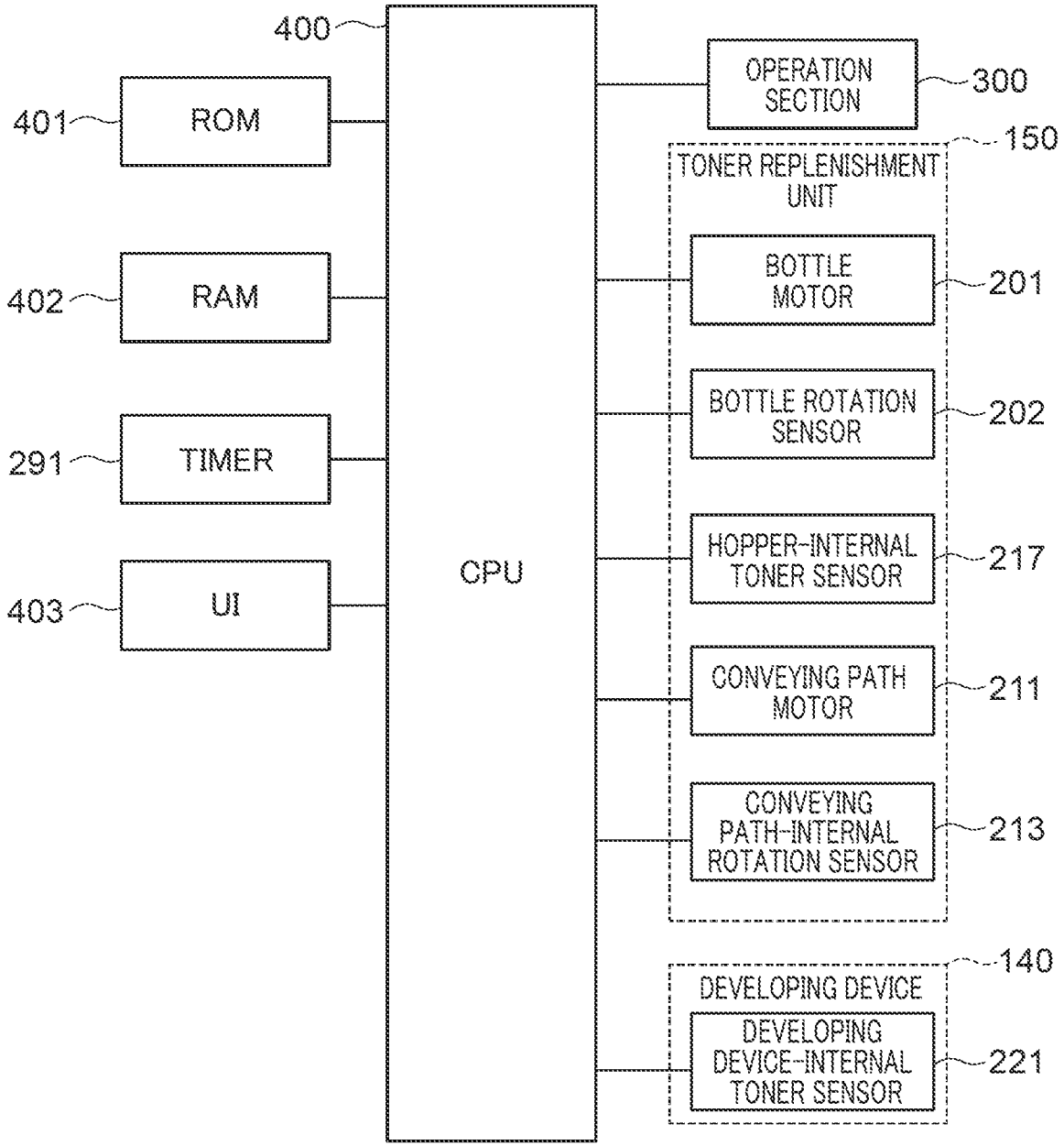
FIG. 2 is a control block diagram of the image forming apparatus.

FIG. 2 is a control block diagram of the image forming apparatus 100. The image forming apparatus 100 includes a CPU 400, a ROM 401, a RAM 402, a timer 291, a UI (user interface) 403, and an operation section 300. The UI 403 includes e.g. a display.

The ROM 401 stores control programs for controlling the overall operation of the image forming apparatus 100. The RAM 402 is a volatile storage device (memory) which is used as a work area for the CPU 400 and is used to temporarily store various data, such as image data. The CPU 400 controls the overall operation of the image forming apparatus 100 by loading the control programs stored in the ROM 401 into the RAM 402, and executing the loaded programs. The CPU 400 controls the operation of the toner replenishment unit 150 by controlling the operations of a bottle motor 201 and a conveying path motor 211. In the toner replenishment unit 150, there are arranged a bottle rotation sensor 202 (first detection unit), a hopper-internal toner sensor 217 (second detection unit), a conveying path-internal rotation sensor 213, and a developing device-internal toner sensor 221. Signals output from these sensors 202, 217, 213, and 221 are input to the CPU 400.

Figure 3A:
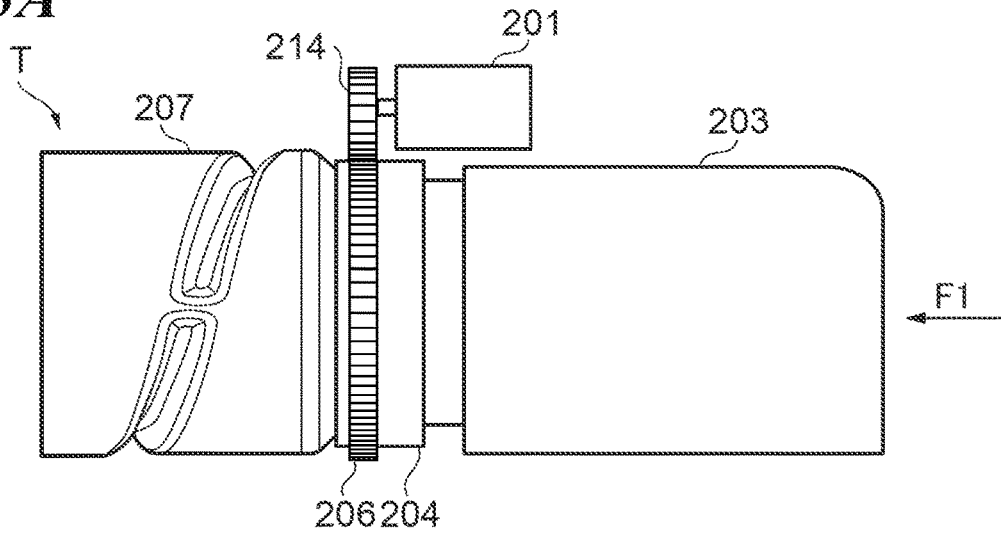
FIGS. 3A to 3C are a view of the appearance of a toner bottle and views of the toner bottle, as viewed from a direction F1.

FIG. 3A is a view of the appearance of the toner bottle T. The toner bottle T is used in a state attached to an attachment section 220 of the toner replenishment unit 150, as described hereinafter with reference to FIG. 4. The toner bottle T is removable from the attachment section 220 and is replaced by a user or a service person. The toner bottle T is a toner container that stores toner used for development by the developing device 140.

As shown in FIG. 3A, the toner bottle T includes a cap part 203, a bottle storage part 207 for storing toner, a drive transmission section 206 to which a rotational driving force is transmitted via a drive gear train 214 from the bottle motor 201, and a discharge port (not shown) from which toner is discharged.

Figure 3B:
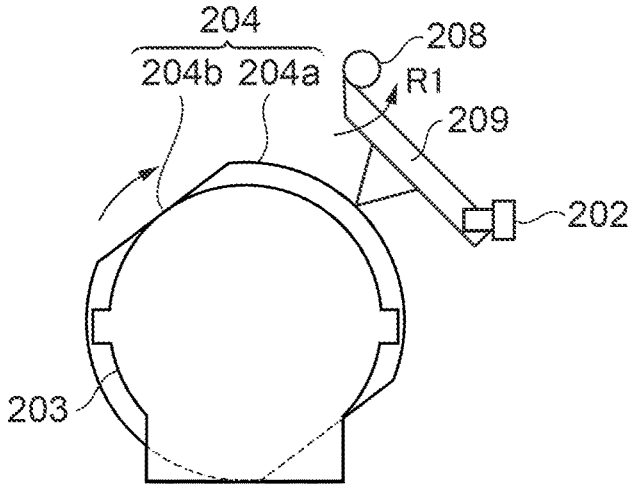
Figure 3C:
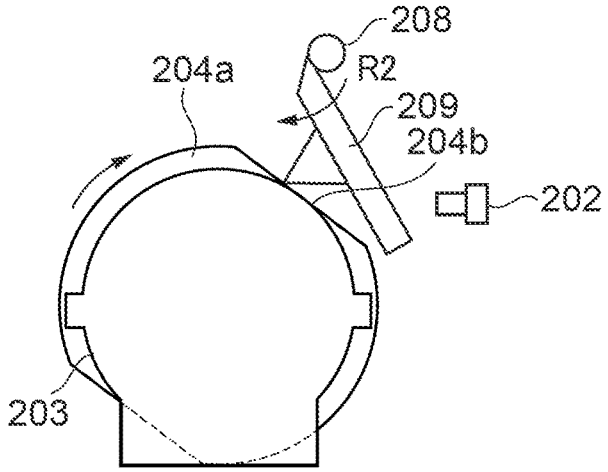

FIGS. 3B and 3C are views of the toner bottle T, as viewed from a direction F1 in FIG. 3A. The bottle rotation sensor 202 is an optical sensor having a light emission section and a light receiving section, neither of which is shown, and outputs a signal corresponding to an amount of light received by the light receiving section. A bottle side 204 is formed with an uneven shape formed by a protruding-shape portion 204*a* and a recessed-shape portion 204*b* for detecting rotation of the toner bottle T. The bottle rotation sensor 202 detects rotation of the toner bottle T according to whether or not light emitted from the light emission section to the light receiving section is blocked by a sensor flag 209. The sensor flag 209 is rotatable about a flag shaft 208.

When the toner bottle T rotates in a clockwise direction, as viewed in FIGS. 3B and 3C, to cause the protruding-shape portion 204*a* to start to be brought into contact with the sensor flag 209, the sensor flag 209 is rotated about the flag shaft 208 in a direction R1. Then, when the sensor flag 209 blocks the optical path between the light emission section and the light receiving section of the bottle rotation sensor 202 (see FIG. 3B), the amount of light received by the light receiving section is reduced to be smaller than a threshold value. On the other hand, when the toner bottle T further rotates in the clockwise direction to cause the recessed-shape portion 204*b* to start to be brought into contact with the sensor flag 209, the sensor flag 209 is rotated about the flag shaft 208 in a direction R2. Then, when the sensor flag 209 is retracted from the optical path between the light emission section and the light receiving section of the bottle rotation sensor 202 (see FIG. 3C), the amount of light received by the light receiving section is increased to be not smaller than the threshold value.

If the amount of light received by the light receiving section of the bottle rotation sensor 202 is smaller than the threshold value, the CPU 400 recognizes that the bottle rotation sensor 202 outputs a low-level signal (see FIG. 3B). If the amount of light received by the light receiving section of the bottle rotation sensor 202 is not smaller than the threshold value, the CPU 400 recognizes that the bottle rotation sensor 202 outputs a high-level signal (see FIG. 3C). In other words, the bottle rotation sensor 202 changes the output value to the binary values of the high level (ON) and the low level (OFF) in accordance with rotation of the toner bottle T. Note that the configuration for detecting rotation of the toner bottle T is not limited to the optical sensor, such as the bottle rotation sensor 202.

Figure 4:
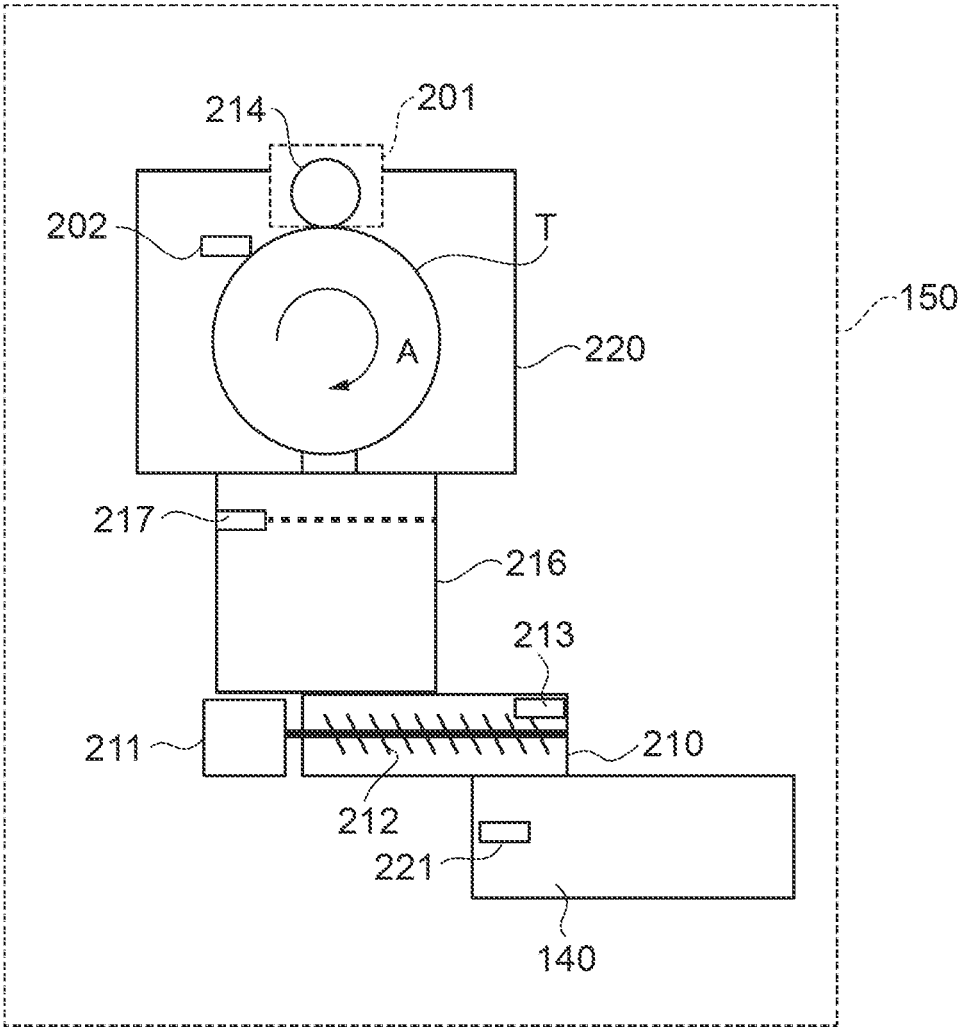
FIG. 4 is a schematic view showing the construction of a toner replenishment unit.

FIG. 4 is a schematic view showing the construction of the toner replenishment unit 150. The toner replenishment unit 150 includes the attachment section 220, the toner bottle T, the bottle motor 201, a hopper 216, a toner conveying path 210, a screw 212, and the conveying path motor 211. The toner bottle T, which is filled with toner in advance, can be attached to the attachment section 220 of the toner replenishment unit 150 e.g. by a user. The hopper 216 as a container plays the role of a buffer for temporarily storing toner discharged from the toner bottle T. The screw 212 as a replenishment unit is disposed within the toner conveying path 210. The toner conveying path 210 is provided between the hopper 216 and the developing device 140, and conveys toner stored in the hopper 216 to the developing device 140 by rotating the screw 212.

The hopper-internal toner sensor 217 for detecting presence/absence of toner in the hopper 216 is provided in the hopper 216. The CPU 400 controls the toner bottle T so as to cause toner to be stored in the hopper 216 up to a boundary face at which the hopper-internal toner sensor 217 is disposed. Details of a method of detecting presence/absence of toner using the hopper-internal toner sensor 217 will be described hereinafter with reference to FIGS. 5A to 5D. The drive transmission section 206 of the toner bottle T receives a rotational drive force via a drive gear train 214 from the bottle motor 201. The bottle motor 201 as a drive unit drives the drive transmission section 206 for rotation, whereby the toner bottle T is rotated in a direction indicated by an arrow A in FIG. 4. When the toner bottle T is rotated, toner is discharged from the inside of the toner bottle T and flows into the hopper 216. The toner stored in the hopper 216 flows into the toner conveying path 210.

A rotational shaft of the screw 212 within the toner conveying path 210 is connected to the conveying path motor 211 via a drive gear train (not shown). A rotational drive force is applied from the conveying path motor 211 to the screw 212 via the drive gear train. The screw 212 conveys toner flowing into the toner conveying path 210 in one direction (from left to right, as viewed in FIG. 4) by its rotation. The toner conveyed through the toner conveying path 210 is replenished to the developing device 140 from an end portion of the toner conveying path 210. Further, the conveying path-internal rotation sensor 213 for detecting rotation of the screw 212 is provided in the toner conveying path 210. The CPU 400 determines whether or not the screw 212 is normally rotated based on the output of the conveying path-internal rotation sensor 213. Inside the developing device 140, the developing device-internal toner sensor 221 for detecting presence/absence of toner in the developing device 140 is provided.

Figure 5A:
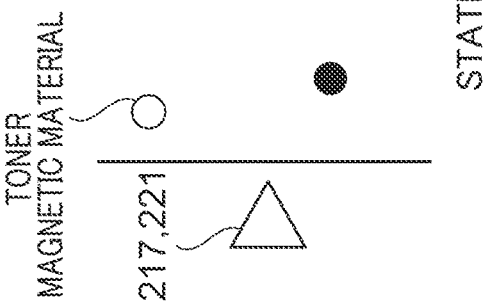
FIGS. 5A to 5D are conceptual views showing states of detection of toner in a toner conveying path and a developing device, and a diagram showing a relationship between the sensor output value and the amount of toner.
Figure 5B:
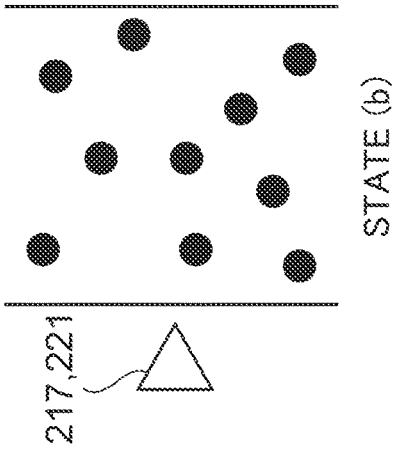
Figure 5C:
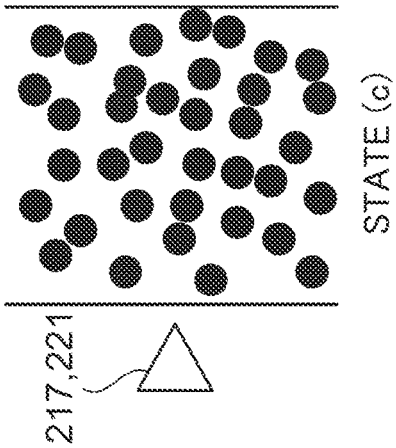
Figure 5D:
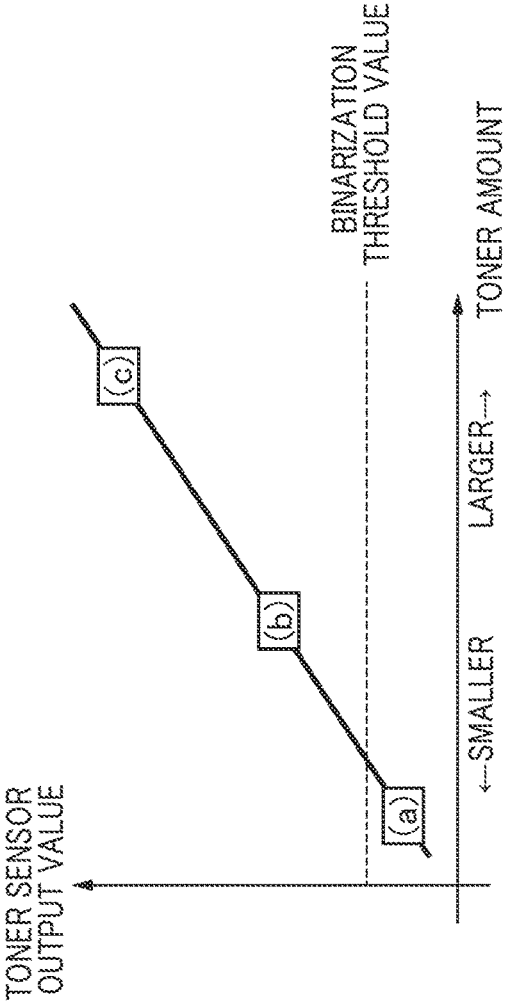

FIGS. 5A to 5C are conceptual views showing states of detection of toner in the toner conveying path 210 and the developing device 140 by the hopper-internal toner sensor 217 and the developing device-internal toner sensor 221. FIG. 5D is a diagram showing a relationship between the sensor output value and the amount of toner in a case where a predetermined voltage is applied to each sensor.

The hopper-internal toner sensor 217 and the developing device-internal toner sensor 221 are both magnetic permeability sensors. FIGS. 5A to 5C schematically show a state in which the amount of toner containing magnetic material is small (state (a)), a state in which the amount of toner is normal (state (b)), and a state in which the amount of toner is large (state (c)), respectively. When a predetermined voltage is applied to the hopper-internal toner sensor 217 and the developing device-internal toner sensor 221, the output value of each sensor increases in proportion to increase in the toner amount, as shown in FIG. 5D.

Further, the CPU 400 uses different control parameters based on sensor output values in a manner adapted to respective usages of the toner sensors 217 and 221. For example, it is necessary to keep the toner density in the developing device 140 constant, and hence the CPU 400 directly uses the sensor output value of the developing device-internal toner sensor 221 as a control parameter. On the other hand, to store a first predetermined amount of toner in the hopper 216, it is only required to determine whether or not there is a corresponding amount of toner. To this end, the CPU 400 compares the output of the hopper-internal toner sensor 217 with a binarization threshold value, and in a case where the output value is not smaller than the binarization threshold value, the CPU 400 acquires a signal indicating that toner is present (ON) as a detection result. On the other hand, in a case where the output value of the hopper-internal toner sensor 217 is smaller than the binarization threshold value, the CPU 400 acquires a signal indicating that toner is absent (OFF) as the detection result. In other words, the output of the toner sensor 217 is changed to ON if the toner amount in the hopper 216 is not smaller than the first predetermined amount, and to OFF if the toner amount in the hopper 216 is smaller than the first predetermined amount. The first predetermined amount corresponds to the position where the toner sensor 217 is disposed (boundary face). The CPU 400 uses the detection result thus obtained by the toner sensor 217 as a control parameter.

The CPU 400 acquires information on presence or absence of toner in the hopper 216 and the toner density in the developing device 140, by monitoring the output signals from the hopper-internal toner sensor 217 and the developing device-internal toner sensor 221 e.g. at intervals of 100 msec. Note that the above-mentioned method of determining presence/absence of toner is described, by way of example, but the configuration for detecting presence/absence of toner using a piezo sensor may be employed. The hopper-internal toner sensor 217 is not necessarily required to be configured to detect presence/absence of toner in the hopper 216, but may be configured to output a value corresponding to the amount of toner.

Figure 6A:
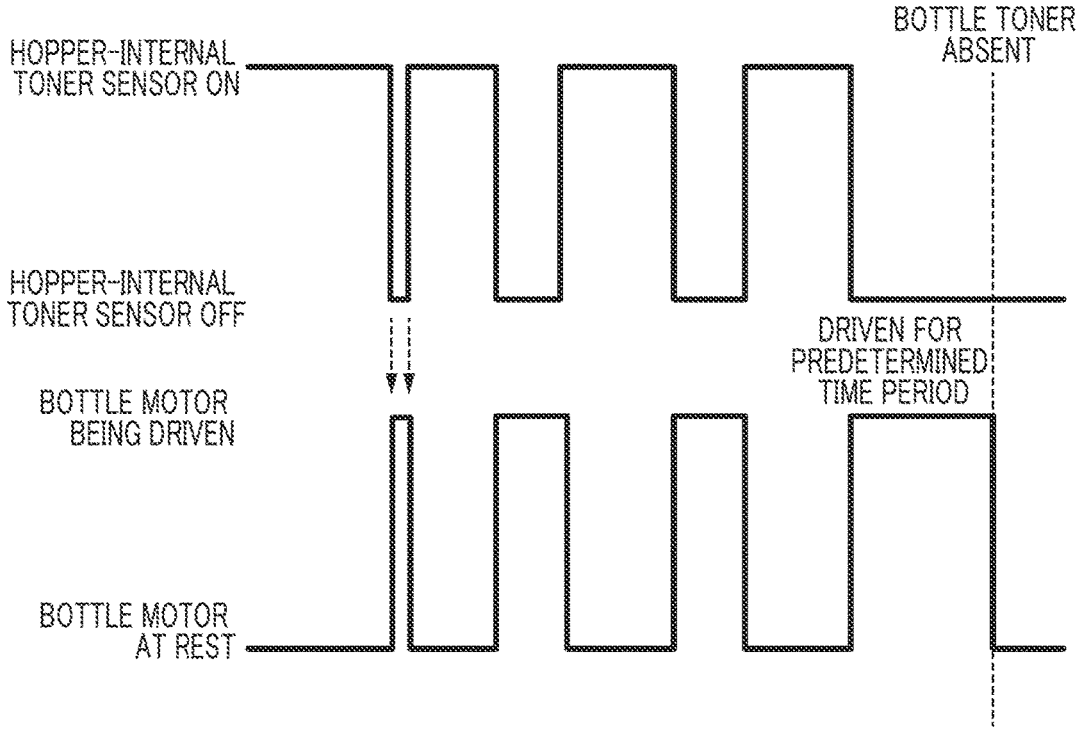
FIGS. 6A and 6B are timing diagrams of a sequence for replenishing toner from the toner bottle to a hopper, and a sequence for replenishing toner from the hopper to the developing device, respectively.

Next, a sequence for replenishing toner from the toner bottle T to the hopper 216 and a sequence for replenishing toner from the hopper 216 to the developing device 140 will be described with reference to FIGS. 6A and 6B. FIG. 6A is a timing diagram of the sequence for replenishing toner from the toner bottle T to the hopper 216.

When the image forming operation is being performed, toner corresponding to image data is discharged from the developing device 140. With this operation, when the toner density in the developing device 140 is lowered, toner is replenished from the hopper 216 to the developing device 140 through the toner conveying path 210 (see FIG. 4). As toner replenishment from the hopper 216 to the developing device 140 is repeated, in due time, it is determined by the hopper-internal toner sensor 217 in the hopper 216 that toner is absent in the hopper 216. When it is determined that toner is absent in the hopper 216, the CPU 400 controls the bottle motor 201 to rotate the toner bottle T. This causes toner to be replenished from the toner bottle T to the hopper 216. Then, in due time, it is determined by the hopper-internal toner sensor 217 that toner is present in the hopper 216. Therefore, the CPU 400 controls toner replenishment such that the toner density in the developing device 140 is kept constant and the amount of toner in the hopper 216 is kept constant.

Incidentally, when the amount of toner in the toner bottle T (in the toner container) becomes smaller than a second predetermined amount, even when the toner bottle T is rotated, toner is no longer replenished to the hopper 216. Therefore, as shown in FIG. 6A, even when the toner bottle T is rotated for a certain time period, the hopper-internal toner sensor 217 does not detect presence of toner (does not output a detection result indicating that toner is present), and hence the CPU 400 determines that the toner bottle T is empty (bottle toner is absent). The fact that the toner bottle T is empty means that the amount of toner in the tonner bottle T is smaller than the second predetermined amount. Note that even when it is determined that the toner bottle T is empty, so long as toner remains in the hopper 216, the image forming operation can be continued.

Here, there is a case where the toner bottle T is disabled from properly rotating (hereinafter referred to as the rotation failure) due to excessive rotation load (too heavy rotation load) of the toner bottle T caused e.g. by faulty attachment of the toner bottle T to the attachment section 220. In this case, when the CPU 400 as a determination unit determines that the toner bottle T is not rotating, the CPU 400 executes an abnormality diagnosis sequence (an abnormality determination process, described hereinafter with reference to FIG. 10) to thereafter display an error display corresponding to a result of the diagnosis on the UI 403, and stops the image forming operation. Further, there is a case where it is impossible to detect an ON edge of the output of the bottle rotation sensor 202 due to failure of the bottle rotation sensor 202. In this case, even when the toner bottle T is actually rotating, the CPU 400 determines that the toner bottle T is not rotating based on a detection result of the bottle rotation sensor 202. To overcome this inconvenience, the CPU 400 executes the above-mentioned abnormality diagnosis sequence. Note that the rotation failure of the toner bottle T is caused not only by faulty attachment, but also by clogging of a pump portion, etc.

Figure 6B:
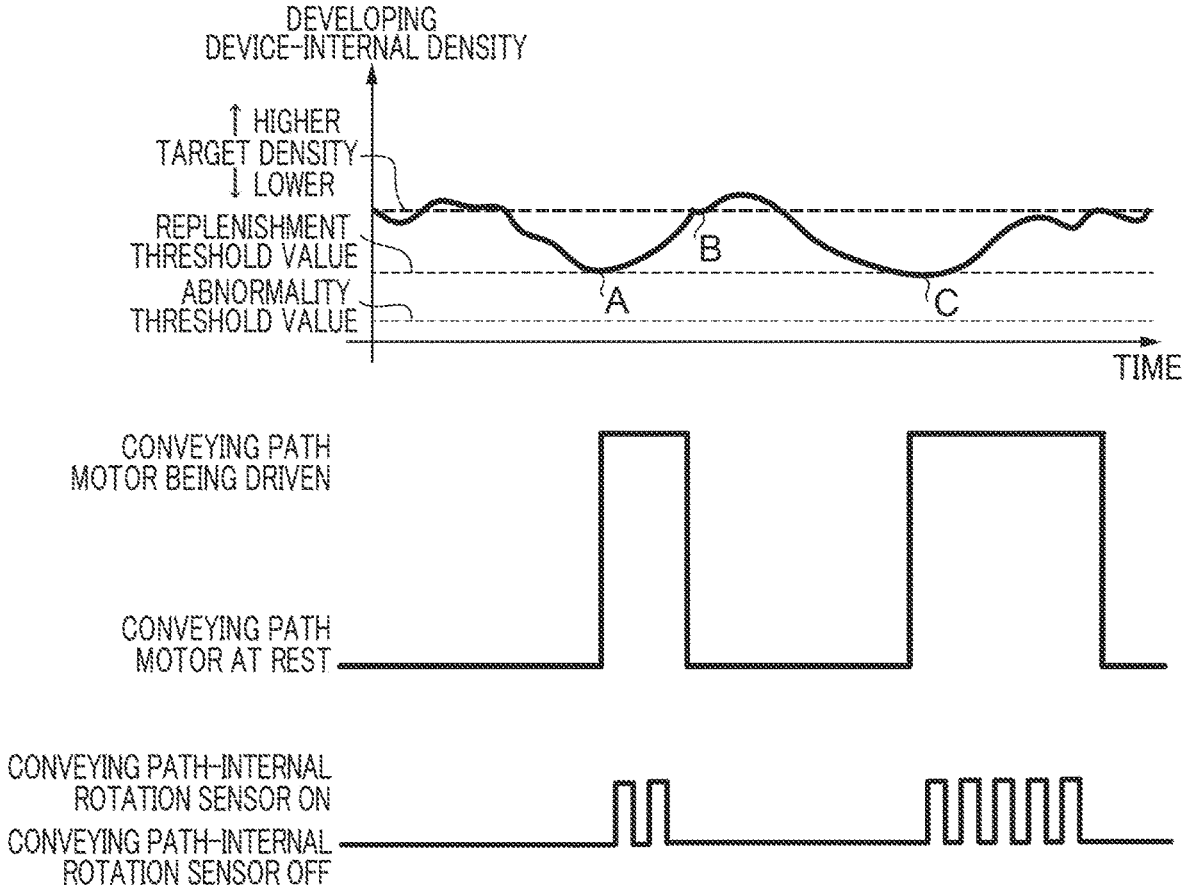

FIG. 6B is the sequence for replenishing toner from the hopper 216 to the developing device 140. Normally, the toner density in the developing device 140 is controlled by the CPU 400 such that it becomes equal to a target density, as shown in FIG. 6B. As toner corresponding to image data is discharged from the developing device 140 during the image forming operation, the toner density is continuously lowered. To keep the toner density in the developing device 140 at the fixed target density, the CPU 400 monitors the output value of the developing device-internal toner sensor 221. In a case where the toner density becomes lower than a replenishment threshold value (as indicated at positions A and C), the CPU 400 controls the conveying path motor 211 to rotate the screw 212. Then, when the toner density reaches the target density (as indicated at a position B), the CPU 400 controls the conveying path motor 211 to stop rotation of the screw 212. Thereafter that, the CPU 400 repeats this operation, whereby it is possible to keep the toner density at a density around the target density. Note that the CPU 400 may control the replenishment operation not only using the output value of the developing device-internal toner sensor 221, but also using e.g. image information used to form an image (such as pixel information).

Next, a method of identifying, in a case where the detection result of the bottle rotation sensor 202 indicates that the toner bottle T is not rotating, whether a non-rotating state of the toner bottle T is caused by failure (abnormality) of the bottle rotation sensor 202 or rotation failure of the toner bottle T will be described with reference to FIGS. 7A to 7C. If the bottle rotation sensor 202 is in failure or the toner bottle T is not rotating, an ON edge of the output of the bottle rotation sensor 202 cannot be detected. If the output value of the bottle rotation sensor 202 does not change for more than a predetermined time period (a time timeY, referred to hereinafter) after starting to drive the toner bottle T for rotation, the CPU 400 determines that the detection result of the bottle rotation sensor 202 indicates that the toner bottle T is not rotating.

Figure 7A:
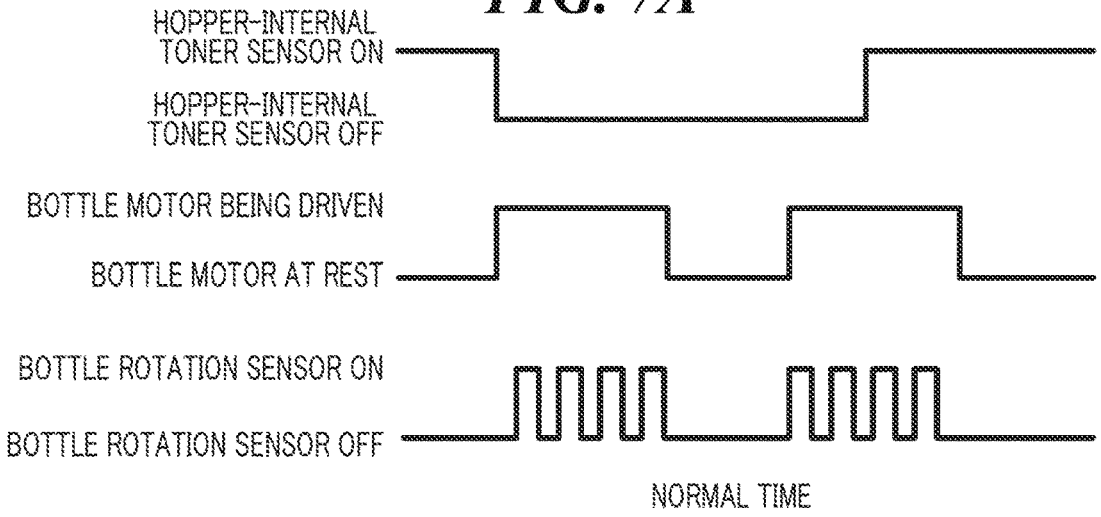
FIGS. 7A to 7C are timing diagrams showing changes in the output of each sensor and the operating state of a bottle motor, during replenishment of toner from the toner bottle to the hopper.
Figure 7B:
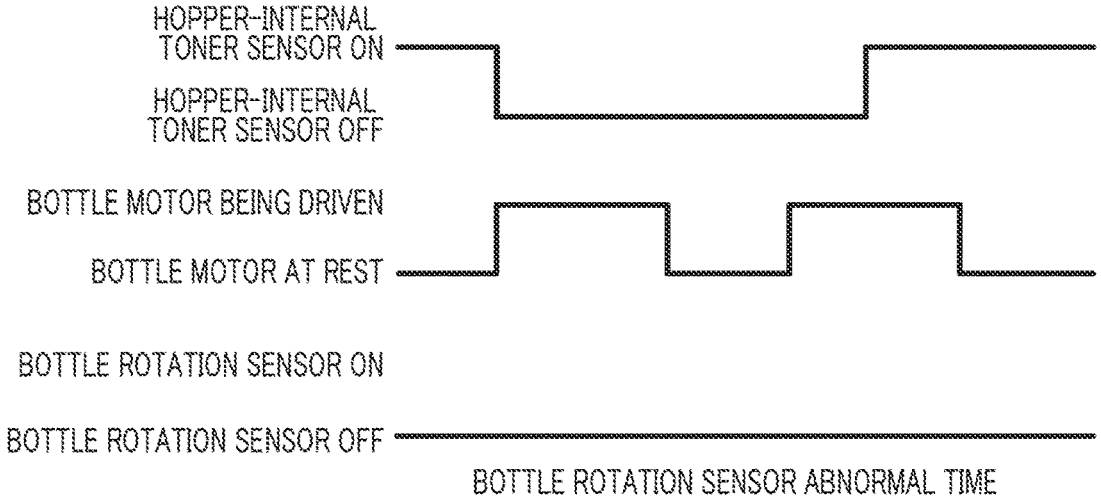
Figure 7C:
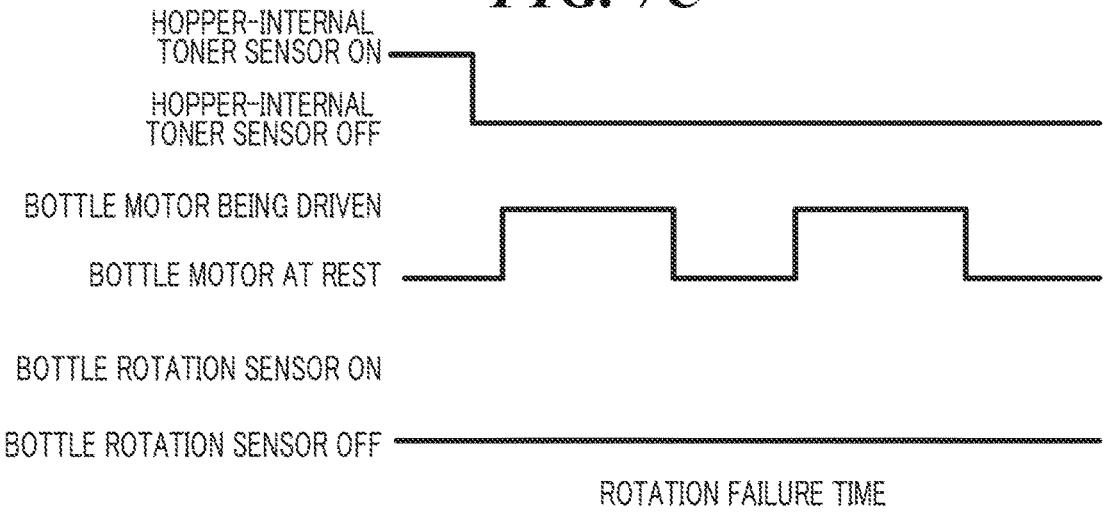

FIGS. 7A to 7C are timing diagrams showing changes in the output of each of the hopper-internal toner sensor 217 and the bottle rotation sensor 202, and the operating state of the bottle motor 201, during replenishment of toner from the toner bottle T to the hopper 216. Particularly, FIG. 7A shows a case where toner replenishment to the hopper 216 is normally performed. FIG. 7B shows a case where an abnormality has occurred in the bottle rotation sensor 202. FIG. 7C shows a case where rotation failure of the toner bottle T has occurred.

During normal toner replenishment, as shown in FIG. 7A, when the output of the in-hopper toner sensor 217 is changed to OFF, the driving of the bottle motor 201 is started in order to replenish toner. The toner bottle T is driven by the bottle motor 201 and the output value of the bottle rotation sensor 202 is repeatedly changed to ON and OFF. When toner is discharged from the toner bottle T and is accumulated in the hopper 216, in due time, the output of the hopper-internal toner sensor 217 is changed to ON. When the driving time of the bottle motor 201 ends, the bottle motor 201 is stopped.

In a case where the bottle rotation sensor 202 is in failure, as shown in FIG. 7B, when the output of the hopper-internal toner sensor 217 is changed to OFF, the driving of the bottle motor 201 is started in order to replenish toner. As a result, although the toner bottle T is rotating, since the bottle rotation sensor 202 is in failure, rotation of the toner bottle T cannot be detected so that the output value is held at OFF. When toner is accumulated in the hopper 216 before the driving time of the bottle motor 201 ends, the output of the hopper-internal toner sensor 217 is changed to ON. In due time, when the operation times out in a state in which the output of the bottle rotation sensor 202 is held at OFF, the operation is shifted to the abnormality diagnosis sequence. Here, the operation times out when the output value of the bottle rotation sensor 202 has not changed for more than a predetermined time period (timeY) after starting to drive the toner bottle T for rotation.

During rotation failure of the toner bottle T, as shown in FIG. 7C, when the output of the hopper-internal toner sensor 217 is changed to OFF, the driving of the bottle motor 201 is started in order to replenish toner. However, the toner bottle T cannot properly rotate e.g. due to faulty attachment thereof, and hence toner is not properly discharged. Therefore, toner is hardly accumulated in the hopper 216, so that the output of the hopper-internal toner sensor 217 is held at OFF. In due time, when the operation times out in a state in which the output of the bottle rotation sensor 202 is held at OFF, the operation is shifted to the abnormality diagnosis sequence. Here, in a case where the output value of the bottle rotation sensor 202 has not changed for more than a predetermined time period (timeY) after starting to drive the toner bottle T for rotation, the operation times out.

Next, the abnormality diagnosis sequence will be described. Conventionally, when the non-rotating state of the toner bottle T is detected by the bottle rotation sensor 202, it has been impossible to identify which unit has made it impossible to detect rotation of the toner bottle T. This is because whether or not the toner bottle T is rotating has been determined only depending on the bottle rotation sensor 202. In contrast, in the present embodiment, the CPU 400 determines which of failure of the bottle rotation sensor 202 and rotation failure of the toner bottle T has occurred, by making use the output of the hopper-internal toner sensor 217.

Here, as a premise, it is assumed that no electrical failure, such as coming-off of a connector of a power supply circuit board or bundled wires, has occurred. In a case where the detection result of the bottle rotation sensor 202 indicates that the toner bottle T is not rotating, the CPU 400 stores the output of the hopper-internal toner sensor 217, obtained at this time, in the RAM 402 as a stored value Pr. For example, although in the illustrated example in FIG. 7B, the stored value Pr indicates "ON" (hopper toner is present), in the illustrated example in FIG. 7C, the stored value Pr indicates "OFF" (hopper toner is absent). If the stored value Pr indicates that toner is present, this means that the toner bottle T is rotating and hence the CPU 400 can determine that the bottle rotation sensor 202 is in failure. On the other hand, if the stored value Pr indicates that toner is absent, this means that the toner bottle T is not rotating and hence the CPU 400 can determine that rotation failure of the toner bottle T has occurred.

However, there is a possibility that the bottle rotation sensor 202 fails in a state in which the toner bottle T is almost out of toner, and hence this situation is also taken into account when performing the determination. Even when the toner bottle T is rotating, toner ceases to be discharged midway through replenishment, and hence the stored value Pr of the hopper-internal toner sensor 217 is changed to "OFF". In this case, if it is uniformly determined that the toner bottle T is in rotation failure, this leads to an erroneous determination.

To avoid this, in the present embodiment, the CPU 400 acquires a toner remaining amount Tr remaining in the toner bottle T at a time point when the operation has timed out in a state in which the output of the bottle rotation sensor 202 is held at OFF. Further, the CPU 400 acquires a replenishment required amount Hr (necessary replenishment amount) of toner to the hopper 216 at a time when the operation has timed out in a state in which the output of the bottle rotation sensor 202 is held at OFF. The replenishment required amount Hr is an amount of toner required to recover the output of the hopper-internal toner sensor 217 from OFF to ON. Then, in a case where the toner remaining amount Tr is smaller than the replenishment required amount Hr, the CPU 400 does not perform determination regarding which of failure of the bottle rotation sensor 202 and rotation failure of the toner bottle T has occurred. Instead, the CPU 400 performs error notification, such as display of the error on the UI 403.

The toner remaining amount Tr can be determined based on the total number of rotations Br2 of the toner bottle T, counted from the start of use of a new toner bottle T. The replenishment required amount Hr can be determined based on the number of rotations Dr of the screw 212 (see FIG. 9), counted after the output of the hopper-internal toner sensor 217 is changed to OFF. The number of rotations Dr is a value indicating an amount of toner reduced by supplying toner from the hopper 216, from a toner amount indicated by a level of toner, which corresponds to the position where the hopper-internal toner sensor 217 is disposed. That is, the number of rotations Dr corresponds to a reduced amount by which toner is reduced after the amount of toner in the hopper 216 becomes smaller than the first predetermined amount.

Next, a process including the sequence for replenishing toner from the toner bottle T to the hopper 216 and an abnormality diagnosis sequence will be described with reference to FIG. 8. FIG. 8 is a flowchart of a bottle driving process. This bottle driving process is realized by the CPU 400 that loads a corresponding control program stored in the ROM 401 into the RAM 402, and executes the loaded program. This process is started when the image forming apparatus 100 is powered on, or when the image forming apparatus 100 is recovered from an error state, and is executed irrespective of whether or not the print operation is being performed.

In a step S801, the CPU 400 waits until it is determined based on the output of the hopper-internal toner sensor 217 that toner is absent in the hopper 216. Then, if it is determined that toner is absent in the hopper 216 because the output of the hopper-internal toner sensor 217 is changed to OFF, the CPU 400 proceeds to a step S802.

In the step S802 and steps S803 and S804, the CPU 400 initializes a bottle toner-absent timer Tx, a bottle rotation sensor timer Ty, and a bottle motor timer Tz to 0. Here, the bottle toner-absent timer Tx is a timer for determining that the amount of toner in the toner bottle T has become smaller than the second predetermined amount (referred to as "bottle toner is absent"). The bottle rotation sensor timer Ty is a timer for determining that the ON edge of the output the bottle rotation sensor 202 is not detected. The bottle motor timer Tz is a timer for monitoring the rotation time of the bottle motor 201. The value counted up by each timer is used by converting the same to a time.

In a step S805, the CPU 400 stores a bottle rotation counter value Br1 stored in the RAM 402, in another address, as the total number of rotations Br2 of the toner bottle T. The CPU 400 can determine the toner remaining amount Tr in the toner bottle T before driving the toner bottle T for rotation, from the total number of rotations Br2 (step S1002 in FIG. 10, referred to hereinafter). The determined toner remaining amount Tr is used to determine whether or not to perform abnormality cause determination (step S1004, referred to hereinafter).

In a step S806, the CPU 400 starts to drive the bottle motor 201 for rotation. This causes the toner bottle T to be rotated. In a step S807, the CPU 400 counts up the bottle motor timer Tz using the timer 291. In a step S808, the CPU 400 determines whether or not the bottle toner-absent timer Tx has timed out. That is, the CPU 400 determines whether or not the count of the bottle toner-absent timer Tx has exceeded a time timeX (e.g. 40 sec). The time timeX is stored in advance in the RAM 402. If it is determined that the bottle toner-absent timer Tx has timed out because Tx>timeX holds, it is determined that the amount of toner in the toner bottle T has become smaller than the second predetermined amount (bottle toner is absent), and hence the CPU 400 proceeds to a step S823. On the other hand, if it is determined that the bottle toner-absent timer Tx has not timed out, the CPU 400 proceeds to a step S809. In the step S809, the CPU 400 counts up the bottle toner-absent timer Tx using the timer 291.

In a step S810, the CPU 400 determines whether or not the bottle rotation sensor timer Ty has timed out. That is, the CPU 400 determines whether or not the count of the bottle rotation sensor timer Ty has exceeded a time timeY. The time timeY is stored in advance in the RAM 402. If it is determined that the bottle rotation sensor timer Ty has timed out because Ty>timeY holds, it is determined that the time timeY has elapsed in a state in which the output of the bottle rotation sensor 202 is held at OFF. In this case, the detection result of the bottle rotation sensor 202 indicates that the toner bottle T is not rotating, and hence there is a possibility that the bottle rotation sensor 202 is in failure or the toner bottle T is in rotation failure. Accordingly, the CPU 400 proceeds to a step S820. On the other hand, if it is determined that the bottle rotation sensor timer Ty has not timed out, the CPU 400 proceeds to a step S811.

In the step S811, the CPU 400 determines whether or not an ON edge of the output of the bottle rotation sensor 202 has been detected. Then, if an ON edge of the output of the bottle rotation sensor 202 has been detected, it is possible to determine that the toner bottle T is rotating, and hence the CPU 400 clears the bottle rotation sensor timer Ty in a step S812. Then, in a step S813, the CPU 400 counts up the bottle rotation counter value Br1, and then proceeds to a step S815. On the other hand, if an ON edge of the output of the bottle rotation sensor 202 has not been detected, the CPU 400 counts up the bottle rotation sensor timer Ty in a step S814, and then proceeds to the step S815.

In the step S815, the CPU 400 determines whether or not the bottle motor timer Tz has timed out. That is, the CPU 400 determines whether or not the bottle motor timer Tz has exceeded a time timeZ (Tz>timeZ). The time timeZ is stored in advance in the RAM 402. If it is determined that the bottle motor timer Tz has not timed out, the CPU 400 returns to the step S807. On the other hand, if it is determined that the bottle motor timer Tz has timed out, the CPU 400 clears the bottle motor timer Tz in a step S816, and then proceeds to a step S817.

In the step S817, the CPU 400 stops driving the bottle motor 201. In a step S818, the CPU 400 determines, based on the output of the hopper-internal toner sensor 217, whether or not toner is present in the hopper 216. Then, if the output of the hopper-internal toner sensor 217 is held at OFF so that it is determined that toner is absent in the hopper 216, the CPU 400 returns to the step S806. On the other hand, if the output of the hopper-internal toner sensor 217 has been changed to ON so that it is determined that toner is present in the hopper 216, the CPU 400 proceeds to a step S819. In the step S819, the CPU 400 initializes the bottle toner-absent timer Tx to 0, and then returns to the step S801.

In the step S820, the CPU 400 initializes the bottle rotation sensor timer Ty to 0. In a step S821, the CPU 400 stops driving the bottle motor 201. In a step S822, the CPU 400 performs the abnormality determination process described hereinafter with reference to FIG. 10, followed by terminating the process in FIG. 8.

In the step S823, the CPU 400 initializes the bottle toner-absent timer Tx to 0. The CPU 400 stops driving the bottle motor 201 in a step S824, and determines that toner is absent in the toner bottle T and stores this fact in the RAM 402 in a step S825, followed by terminating the process in FIG. 8.

Figure 9:
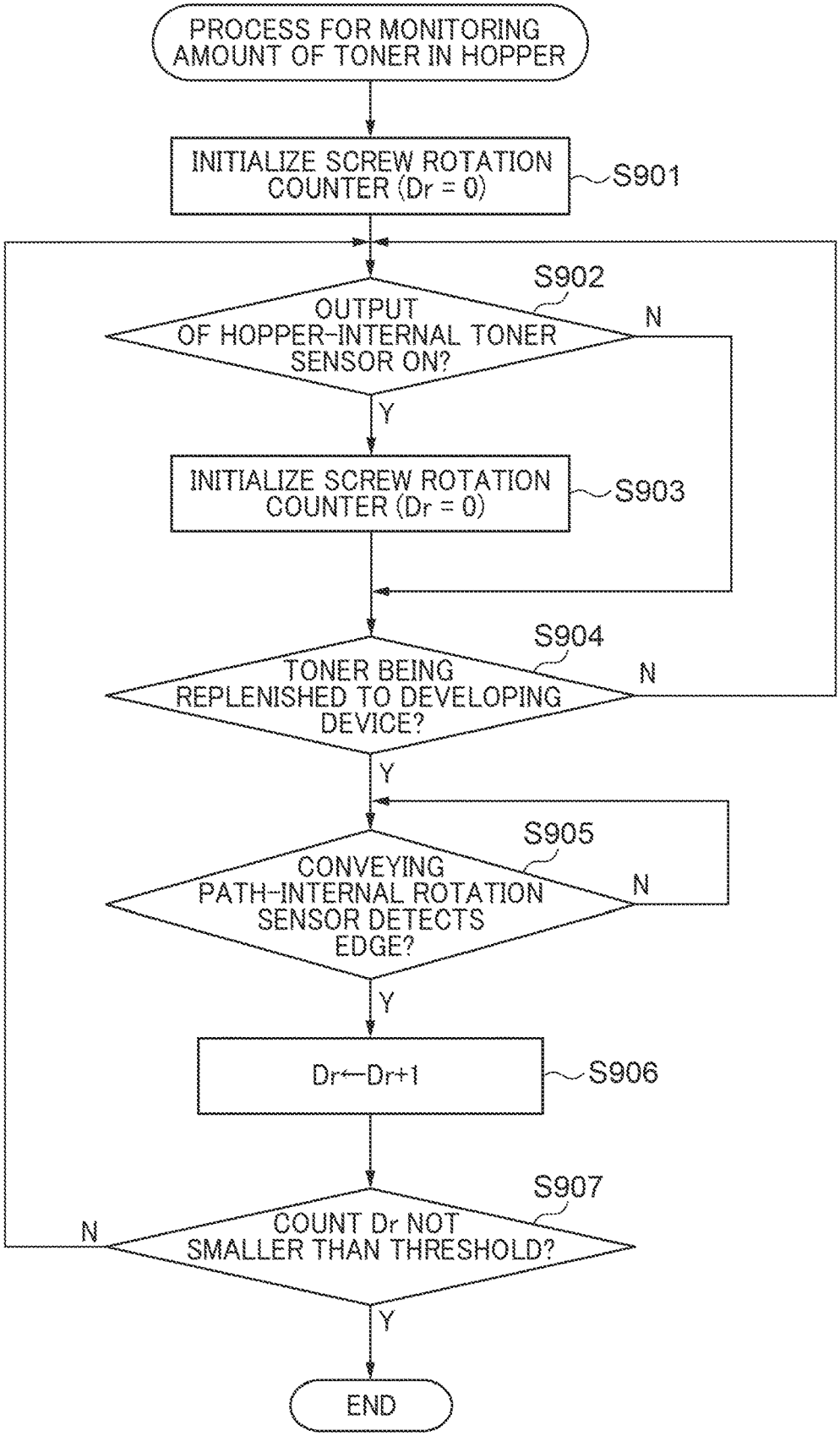
FIG. 9 is a flowchart of a process for monitoring the amount of toner in the hopper.

FIG. 9 is a flowchart of a process for monitoring the amount of toner in the hopper. This process is realized by the CPU 400 that loads an corresponding control program stored in the ROM 401 into the RAM 402, and executes the loaded program. This process is performed in parallel with the bottle driving process in FIG. 8 after the power of the image forming apparatus 100 is turned on. This process is performed to acquire the number of rotations Dr of the screw 212 after the output of the hopper-internal toner sensor 217 is changed to OFF.

In a step S901, the CPU 400 initializes a rotation counter (the number of rotations Dr) of the screw 212. The screw rotation counter is used to record how many rotations the screw 212 make after the output of the hopper-internal toner sensor 217 is changed to OFF. The number of rotations Dr is used to obtain the amount of toner in the hopper 216 and further the replenishment required amount Hr.

In a step S902, the CPU 400 determines whether or not the output of the hopper-internal toner sensor 217 is ON. Then, if the output of the hopper-internal toner sensor 217 is ON, in a step S903, the CPU 400 initializes the screw rotation counter, and then proceeds to a step S904. However, if the output of the hopper-internal toner sensor 217 is OFF, the CPU 400 proceeds to the step S904 without initializing the counter.

In the step S904, the CPU 400 determines whether or not toner is being replenished from the hopper 216 to the developing device 140. This is determined, for example, based on whether or not the CPU 400 controls to drive the conveying path motor 211. Then, if toner is not being replenished from the hopper 216 to the developing device 140, the screw 212 is not rotated, and hence the CPU 400 returns to the S902. On the other hand, if toner is being replenished from the hopper 216 to the developing device 140, the CPU 400 proceeds to a step S905, wherein the CPU 400 waits until an edge of the output of the conveying path-internal rotation sensor 213 is detected. When an edge of the output of the conveying path-internal rotation sensor 213 is detected, the CPU 400 counts up the screw rotation counter (Dr←Dr+1) in a step S06. The value of the screw rotation counter is stored in the RAM 402 as the number of rotations Dr. Note that in repeating the step S905, a step for detecting an error caused by timeout may be provided, and occurrence of the error may be notified to the user.

In a step S907, the CPU 400 determines whether or not the value of the screw rotation counter (Dr) is not smaller than a threshold value. The threshold value is set to a value corresponding to the first predetermined amount of toner in the hopper 216. Then, if Dr<the threshold value holds, the CPU 400 returns to the step S902. On the other hand, if Dr≥the threshold value holds, it can be determined that all of toner in the hopper 216 has been discharged to the developing device 140, and hence the CPU 400 terminates the process in FIG. 9.

Figure 10:
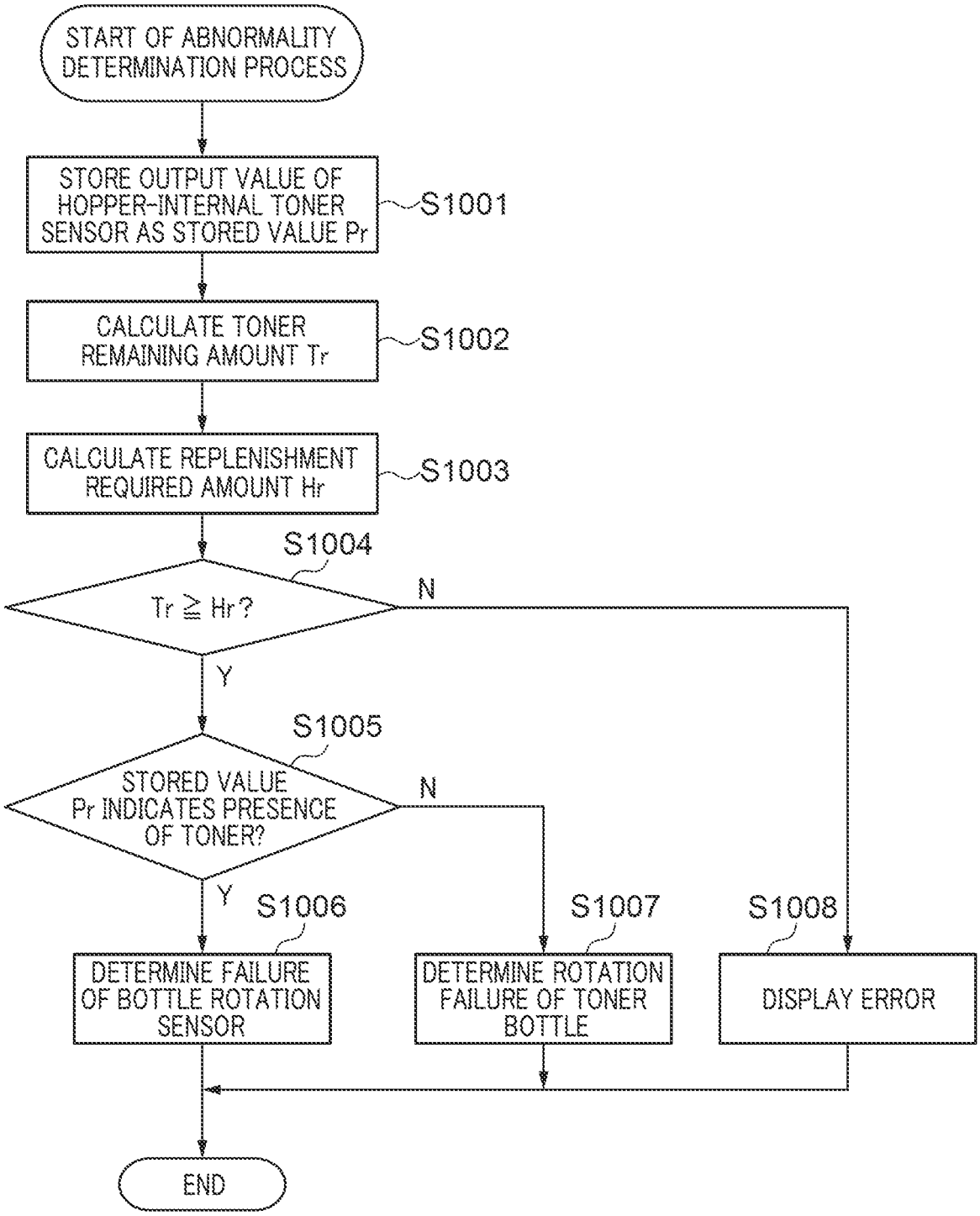
FIG. 10 is a flowchart of an abnormality determination process.

FIG. 10 is a flowchart of the abnormality determination process executed in the step S822 in FIG. 8. FIGS. 11A to 11C are diagrams each showing an example of display of an abnormality notification. First, in a step S1001, the CPU 400 holds the output value of the hopper-internal toner sensor 217 in the RAM 402 as the stored value Pr. Note that the stored value Pr may be stored in another timing provided that it is after the detection result of the bottle rotation sensor 202 indicates that the toner bottle T is not rotating and before executing a step S1005. In the step S1002, the CPU 400 calculates the toner remaining amount Tr in the toner bottle T from the total number of rotations Br2 stored in the RAM 402. An estimated value ABr of the number of rotations of the bottle, which is required to use up all toner in a new toner bottle T, is known. Therefore, the toner remaining amount Tr is calculated by $Tr=\beta(ABr-Br1)$. Here, the constant $\beta$ is a value determined based on e.g. the shape of the toner bottle T and a physical property value of the toner, and is known. Note that the method of acquiring the toner remaining amount Tr is not limited to this example. The toner remaining amount Tr may be acquired, for example, by the method of detecting an actual remaining amount in the toner bottle T or by the method of detecting an actual amount of toner discharged from the toner bottle T.

In a step S1003, the CPU 400 calculates the replenishment required amount Hr based on the number of rotations Dr which is a value of the screw rotation counter. Assuming that an average value of the amount of toner discharged per one rotation of the screw 212 is represented by $\alpha$, the replenishment required amount Hr is calculated by $Hr=\alpha Dr$. Note that the method of acquiring the replenishment required amount Hr is not limited to the above-mentioned example. For example, the replenishment required amount Hr may be calculated from the rotation time of the screw 212 or by the method of detecting an amount of toner actually discharged from the hopper 216. In the step S1004, the CPU 400 determines whether or not the toner remaining amount Tr is not smaller than the replenishment required amount Hr (necessary replenishment amount) of toner to the hopper 216 ($Tr \geq Hr$). If $Tr \geq Hr$ holds, the current toner remaining amount Tr makes it possible to replenish the replenishment required amount Hr of toner to the hopper 216, and hence the CPU 400 proceeds to the step S1005. However, if $Tr < Hr$ holds, the current toner remaining amount Tr makes it impossible to replenish the replenishment required amount Hr of toner to the hopper 216, and hence the CPU 400 proceeds to a step S1008.

In the step S1005, the CPU 400 determines whether or not the stored value Pr stored in the RAM 402 is "ON" (indicating that hopper toner is present). Then, if the stored value Pr is "ON", in a step S1006, the CPU 400 determines that the bottle rotation sensor 202 is in failure. In this case, the CPU 400 displays a message indicating that the hopper 216 is identified as a unit corresponding to the abnormal spot, on the UI 403 (see FIG. 11A), followed by terminating the process in FIG. 10. On the other hand, if the stored value Pr is "OFF" (indicating that hopper toner is absent), in a step S1007, the CPU 400 determines that rotation failure of the toner bottle T has occurred. In this case, the CPU 400 displays a message indicating that the toner bottle T is identified as a unit corresponding to the abnormal spot, on the UI 403 (see FIG. 11B), followed by terminating the process in FIG. 10.

In the step S1008, the CPU 400 performs error display, followed by terminating the process in FIG. 10. That is, in a case where the toner remaining amount Tr is smaller than the replenishment required amount Hr, the determination regarding which of failure of the bottle rotation sensor 202 and rotation failure of the toner bottle T has occurred is not performed. In the error display in the step S1008, the CPU 400 displays, for example, a message to the effect that the cause of the abnormality (abnormal spot) cannot be identified, on the UI 403 (see FIG. 11C), followed by terminating the process in FIG. 10.

Note that the manner of error notification is not limited to the error display, shown in FIGS. 11A to 11C, but the error may be notified using e.g. voice.

According to the present embodiment, the CPU 400 determines which of failure of the bottle rotation sensor 202 and rotation failure of the toner bottle T has occurred, based on the detection result of the bottle rotation sensor 202 and the detection result of the hopper-internal toner sensor 217. The CPU 400 performs determination of the cause of the abnormality according to a detection result of the bottle rotation sensor 202, which indicates that the toner bottle T is not rotating. More specifically, the CPU 400 performs determination of the cause of the abnormality based on the output of the hopper-internal toner sensor 217 (stored value Pr) stored when it is determined that the toner bottle T is not rotating (step S1005). That is, in a case where the stored value Pr indicates that the amount of toner in the hopper 216 is not smaller than the first predetermined amount, the CPU 400 determines that the bottle rotation sensor 202 is in failure. On the other hand, in a case where the stored value Pr indicates that the amount of toner in the hopper 216 is smaller than the first predetermined amount, the CPU 400 determines that rotation failure of the toner bottle T has occurred. With this, it is possible to determine which of failure of the detection unit (bottle rotation sensor 202) for detecting rotation of the toner bottle T and rotation failure of the toner bottle T has occurred without providing a component, such as a current detecting circuit, for detecting a drive load of the bottle motor 201. Therefore, labor of a service person, for identifying the cause of a failure, is reduced, which makes it possible to reduce downtime. Further, this also contributes to cost reduction.

Further, in a case where the toner remaining amount Tr is smaller than the replenishment required amount Hr, the determination regarding which of failure of the bottle rotation sensor 202 and rotation failure of the toner bottle T has occurred is not performed. With this, it is possible to prevent erroneous determination which can occur e.g. in a case where the bottle rotation sensor 202 is in failure in a state in which the toner bottle T is almost out of toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-002018 filed Jan. 9, 2019, which is hereby incorporated by reference herein in its entirety.

What is claimed is:

1. An image forming apparatus comprising:

a photosensitive member;

an exposure unit configured to expose the photosensitive member to form an electrostatic latent image;

a developing unit configured to develop the electrostatic latent image formed on the photosensitive member with toner;

an attachment section to which a toner container that stores toner is attachable;

a drive unit configured to drive the toner container attached to the attachment section, for rotation, to discharge toner from the toner container;

a storage section configured to store the toner discharged from the toner container attached to the attachment section;

a replenishment unit configured to replenish the toner stored in the storage section to the developing unit;

a first detection unit configured to detect rotation of the toner container attached to the attachment section;

a second detection unit configured to detect the toner stored in the storage section; and a determination unit configured to determine, based on a detection result of the first detection unit and a detection result of the second detection unit, which of failure of the first detection unit and rotation failure of the toner container has occurred.

2. The image forming apparatus according to claim 1, wherein the determination unit determines, based on the detection result of the second detection unit acquired in a case where the detection result of the first detection unit indicates that the toner container is not rotating, which of failure of the first detection unit and rotation failure of the toner container has occurred.

3. The image forming apparatus according to claim 2, wherein in a case where the detection result of the second detection unit acquired in a case where the detection result of the first detection unit indicates that the toner container is not rotating indicates that an amount of toner stored in the storage section is not smaller than a predetermined amount, the determination unit determines that failure of the first detection unit has occurred, whereas in a case where the detection result of the second detection unit acquired in a case where the detection result of the first detection unit indicates that the toner container is not rotating indicates that the amount of toner stored in the storage section is smaller than the predetermined amount, the determination unit determines that rotation failure of the toner container has occurred.

4. The image forming apparatus according to claim 2, wherein the first detection unit converts an output value thereof to binary values according to rotation of the toner container, and wherein indication of the detection result of the first detection unit that the toner container is not rotating includes that the output value of the first detection unit has not changed for more than a predetermined time period.

5. The image forming apparatus according to claim 1, wherein the drive unit drives the toner container attached to the attachment section, for rotation, based on the detection result of the second detection unit, and wherein in a case where the detection result of the first detection unit indicates that the toner container is not rotating, the determination unit acquires a toner remaining amount in the toner container attached to the attachment section, and acquires a necessary replenishment amount of toner to the storage section, and in a case where the toner remaining amount is not smaller than the necessary replenishment amount of toner, the determination unit performs determination regarding which of failure of the first detection unit and rotation failure of the toner container has occurred, whereas in a case where the toner remaining amount is smaller than the necessary replenishment amount of toner, the determination unit does not perform the determination regarding which of failure of the first detection unit and rotation failure of the toner container has occurred.

6. The image forming apparatus according to claim 5, wherein in a case where the determination unit does not perform the determination regarding which of failure of the first detection unit and rotation failure of the toner container has occurred in spite of the fact that the detection result of the first detection unit indicates that the toner container is not rotating, the determination unit notifies an error.

7. The image forming apparatus according to claim 1, wherein in a case where it is determined that failure of the first detection unit or rotation failure of the toner container has occurred, the determination unit notifies this fact.

8. An image forming apparatus comprising:

a photosensitive member;

an exposure unit configured to expose the photosensitive member to form an electrostatic latent image;

a developing unit configured to develop the electrostatic latent image formed on the photosensitive member with toner in a buffer;

an attachment section to which a toner container that contains toner is attachable;

a drive unit configured to drive the toner container attached to the attachment section, for rotation, to discharge toner from the toner container;

a replenishment unit configured to replenish the toner from the toner container to the buffer;

a memory configured to store information related to a remaining amount of toner in the toner container attached to the attachment section;

a rotation detecting sensor configured to detect rotation of the toner container attached to the attachment section;

a toner sensor configured to detect the toner stored in the buffer; and a controller configured to:

control the replenishment unit;

control the drive unit based on a detection result of the toner sensor; and in a case where the rotation of the toner container is not detected by the rotation detecting sensor even though the toner container is instructed to rotate, identify failure of the rotation detecting sensor, based on the information stored in the memory and based on the detection result of the toner sensor.

9. The image forming apparatus according to claim 8, wherein in a case where a non-detected time during which rotation of the toner container is not detected exceeds a predetermined time period even though the toner container is instructed to rotate, the controller identifies failure of the rotation detecting sensor based on the information stored in the memory and based on the detection result of the toner sensor.

10. The image forming apparatus according to claim 8, wherein in a case where a non-detected time during which rotation of the toner container is not detected exceeds a predetermined time period even though the toner container is instructed to rotate, the controller controls the drive unit to stop the rotation of the toner container.

11. The image forming apparatus according to claim 8, wherein in a case where a non-detected time during which rotation of the toner container is not detected exceeds a predetermined time period even though the toner container is instructed to rotate, if the remaining amount is a replenishment required amount or more, based on the information, and toner in the buffer is detected by the toner sensor, the controller identifies failure of the rotation detecting sensor.

12. The image forming apparatus according to claim 8, wherein in a case where a non-detected time during which rotation of the toner container is not detected exceeds a predetermined time period even though the toner container is instructed to rotate, if the remaining amount is a replenishment required amount or more, based on the information, and toner in the buffer is detected by the toner sensor, the controller identifies failure of the rotation detecting sensor, and in a case where the non-detected time during which rotation of the toner container is not detected exceeds the predetermined time period even though the toner container is instructed to rotate, if the remaining amount is the replenishment required amount or more, based on the information, and toner in the buffer is not detected by the toner sensor, the controller identifies rotation failure of the toner container.

13. The image forming apparatus according to claim 8, wherein the information includes a number of the rotations of the toner container.

* * * * *